US005078045A

United States Patent [19]

Audino et al.

[11] Patent Number: 5,078,045

[45] Date of Patent: Jan. 7, 1992

[54] GUN MOUNT EXERCISER (GME)

[75] Inventors: Michael J. Audino, Albany; Gary Brownell, Tribes Hill; John Jorczak, Castleton; Victor Nerses, Albany, all of N.Y.

[73] Assignee: The United States of America as represented by the Secretary of the Army, Washington, D.C.

[21] Appl. No.: 642,245

[22] Filed: Jan. 16, 1991

[51] Int. Cl.[5] ..... F41A 25/02; F41A 25/26

[52] U.S. Cl. ..... 89/43.01; 89/1.1; 73/167

[58] Field of Search ..... 89/42.01, 43.01, 198, 89/1.1, 37.01, 40.04, 1.11; 73/167

[56] References Cited

U.S. PATENT DOCUMENTS 2,785,606 3/1957 Bock et al. ..... 89/43.01
4,038,905 8/1977 DuPont, Jr. et al. ..... 89/43.01

FOREIGN PATENT DOCUMENTS 168899 1/1986 European Pat. Off. ..... 73/167.
4597 of 1890 United Kingdom ..... 89/43.01

*Primary Examiner*—Deborah L. Kyle
*Assistant Examiner*—Stephen Johnson
*Attorney, Agent, or Firm*—Peter A. Taucher; David L. Kuhn

[57] ABSTRACT

The invention is a gun mount exerciser to force a cannon through its recoil motion which otherwise occurs only when the cannon is fired. The exerciser includes a frame that rests on the outer casing that is fixed around the cannon. The frame is translated on a stationary member by actuation of a fluidically operated cylinder mounted to the stationary member. The frame is fixed to the outer casing of the gun so that translation of the frame effects translation of the outer casing and the cannon itself.

10 Claims, 3 Drawing Sheets

GUN MOUNT EXERCISER (GME)

GOVERNMENT USE

The invention described herein may be manufactured, used and licensed by or for the U.S. Government for governmental purposes without payment to us of any royalty thereon.

BACKGROUND

Main battle tanks, such as the U.S. Army's M1A1 Abrams Tank, are sometimes stored and thus have less cannon firing activity than tanks which are assigned to active military units. Even tanks in active units may not be fired for prolonged periods. The gun mount assembly, which absorbs the recoil energy of the cannon when it is fired, can be harmed by these lengthy periods of inactivity. The assembly functions similarly to a shock absorber on an automobile and contains hydraulic fluid which is used as the primary energy absorbing medium. The gun mount assembly has dynamic seals which contain the hydraulic fluid under pressure. These seals remain well lubricated on tank cannons which are continually fired. On cannons that are rarely fired, these seals can dry out, become brittle, and are subject to adhesion with mating metal surfaces. Under these conditions, seals can degrade and fail immediately when put back into service. Seal failure leads to an excessive leakage of hydraulic fluid from the gun mount assembly. A tank cannon with failed seals is unfit for service since an attempt to fire the cannon will result in catastrophic failure of the gun mount assembly. The failure will result from insufficient energy absorbtion by hydraulic fluid in the gun mount assembly.

There are now only two standard methods for exercising guns, i.e., causing them to imitate their recoil motion so as to wet the dynamic seals with hydraulic fluid. The first method involves a wrecker vehicle using its hoist to push against the end of the cannon barrel. The second method involves the use of a hand pump (such as the U.S. Army M3 hand pump) which fills the gun mount assembly with extra hydraulic fluid, thus pushing the cannon out of the battery and thereby lubricating the dynamic seals. These procedures have been in existence since the advent of the U.S. Army's M60 tanks in the 1950's.

Tanks in storage warehouses are parked very close together. The space between any two tanks is normally 12 to 18 inches. Typically there are 60 tanks in a building and the tanks are stored without fuel or batteries. To exercise the gun mount assemblies of these tanks using a wrecker, the tanks have fuel and batteries installed. The tanks must then be driven out of the building so that the wrecker has room to get in front of each tank and push the tank's gun barrel with the wrecker hoist. In addition to wasting fuel, the wrecker method is labor intensive and usually takes 6 personnel about a week to exercise all 60 tanks in the building. Additionally, the controls operating the hoist are unable to stop the hoist at exact locations, so that there is a possibility of pushing the gun barrel beyond design limits for recoil travel. Also, it is not always possible for the hoist to apply force at the end of the gun barrel exactly parallel to the gun barrel. This means that the hoist tends to lift or lower the barrel while pushing it, thus placing potentially harmful loads on the gun mount assembly and the gun elevation system.

To exercise the gun mount assemblies using the M3 hand pump, one must enter the vehicle to connect the hand pump directly to a fitting on the gun mount assembly. To do this, one must first remove a replenisher hose on the fitting that leads from a hydraulic fluid reservoir, thereby spilling fluid onto the floor of the tank. Also, opening the hydraulic system to air may cause fluid contamination and consequent corrosion of internal gun mount assembly components and shorter seal life. Furthermore, when using the U.S. Army's M3 hand pump to exercise the gun mount, one needs 400 to 500 strokes of the pump handle to provide sufficient force to push the cannon barrel back the required exercising distance of 6 to 8 inches. Since the gun mount system on which the M3 is used must be exercised 3 times, the number of M3 pump strokes needed to fully exercise the gun mount assembly is 1200 to 1500 strokes.

SUMMARY OF THE INVENTION

Our invention is a gun mount exerciser that avoids using a wrecker vehicle and also avoids opening the hydraulic line of the gun mount assembly. Our gun exerciser mounts to the exterior of the tank and is adapted to be used with a motor driven hydraulic pump. Excessive labor, vehicle entry, fluid spillage and risk of fluid contamination associated with the standard hand pump method of exercising guns is eliminated.

With our gun mount exerciser, a group of 60 tanks can be exercised by one person in a day and a half. In addition, the tank does not have to be moved when using our invention, so that fuel use and wear on the engine, transmission, and track of the tank is avoided.

Our gun mount exerciser includes a hydraulic cylinder mounted to a stationary member anchored to a turret member of the tank. The cylinder pushes a frame which is fixed relative to the cannon and which translates relative to the turret member when the hydraulic cylinder is actuated. Actuation of the cylinder translates the cannon in mimicry of the recoil motion of the cannon. Our gun mount exerciser also includes a hand operated pump fixed to the frame for use when a motorized pumping is not possible or practical.

DETAILED DESCRIPTION

Figure 1:
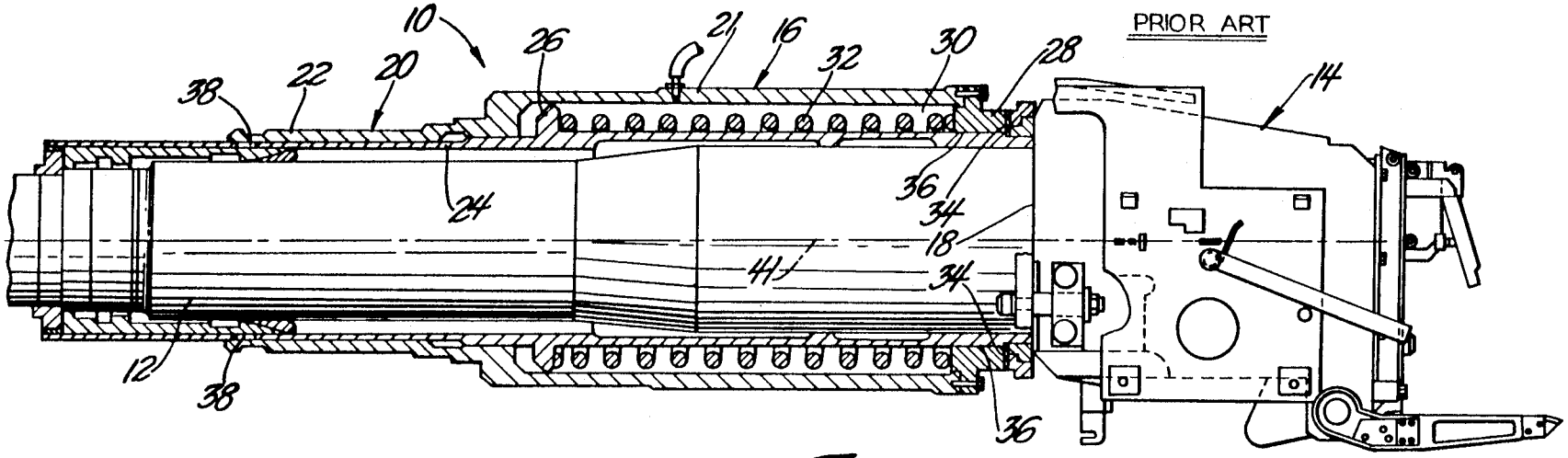
FIG. 1 is a partially sectioned view of a gun mount assembly, the breech mechanism of the assembly being unsectioned and the recoil mechanism of the assembly being shown in section. A portion of the cannon is also shown.
Figure 5:
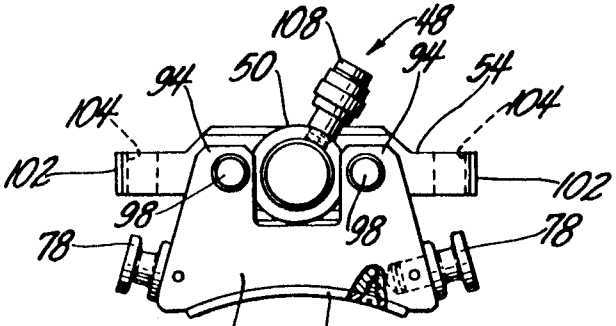
FIG. 5 is an end elevational view of the mounted cylinder assembly of our gun mount exerciser.
Figure 3:
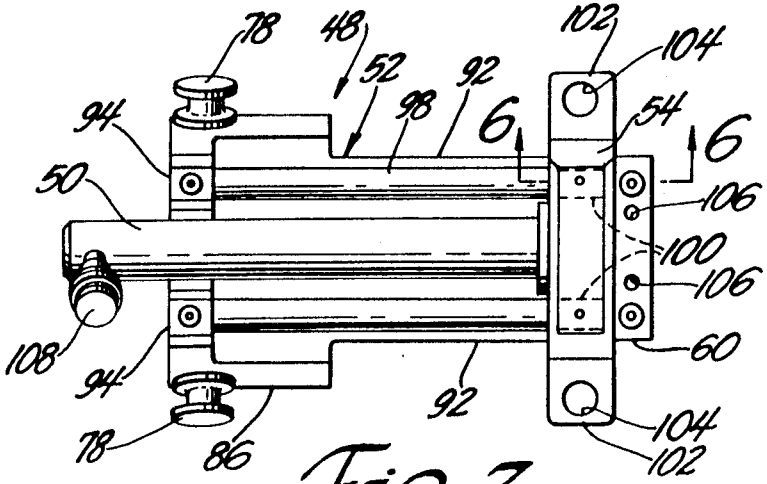
FIG. 3 is a plan view of the mounted cylinder assembly of our gun mount exerciser.

Shown in FIG. 1 is a partially cross-sectioned view of a typical gun mount assembly 10 for the cannon 12 of a tank (not shown). Assembly 10 includes two major subcomponents, the breech mechanism 14 and the recoil unit 16. These subcomponents interface at line 18 of the figure. Recoil unit 16 is essentially a shock absorber to accept some of the force imparted to cannon 12 when it is fired.

Recoil mechanism 16 is comprised of cylindrical elements concentric with axis 41. The first of these elements, outer cylindrical wall 20, is divided into a thicker walled, larger diameter section 21 and a thinner walled, smaller diameter section 22. Concentric with outer cylindrical wall 20 and slidable therein is an inner cylinder 24 having an annular flange 26 protruding to the inner peripheral surface of larger diameter section 21 of the outer cylindrical wall. End ring 28, section 21, flange 26 and inner cylinder 24 together enclose an elongate toroidal space 30 which accommodates recoil spring 32. Hydraulic fluid within toroidal space 30 resists the axial translation of flange 26, whose outer diameter is sized to restrict but not prevent the flow of fluid from one side of the flange to the other. Fixed within inner cylinder 24 and translatable therewith relative to the outer wall is cannon 12, whose recoil after firing translates itself, breech mechanism 14 and inner cylinder 24 to the right in FIG. 1. Outer wall 20 remains stationary during recoil.

Outer cylindrical wall 20 and end ring 28, which is fixed thereto, have dynamic seals to retain the fluid in toroidal space 30 when inner cylinder 24 translates. End ring 28 has seals 34 and 36 while smaller diameter section 22 of outer cylindrical wall 20 has seal 38. When cannon 12 and inner cylinder 24 translate back and forth, as during firing of the cannon, hydraulic fluid is worked into contact with the dynamic seals, thereby preventing them from drying out and cracking.

Figure 2:
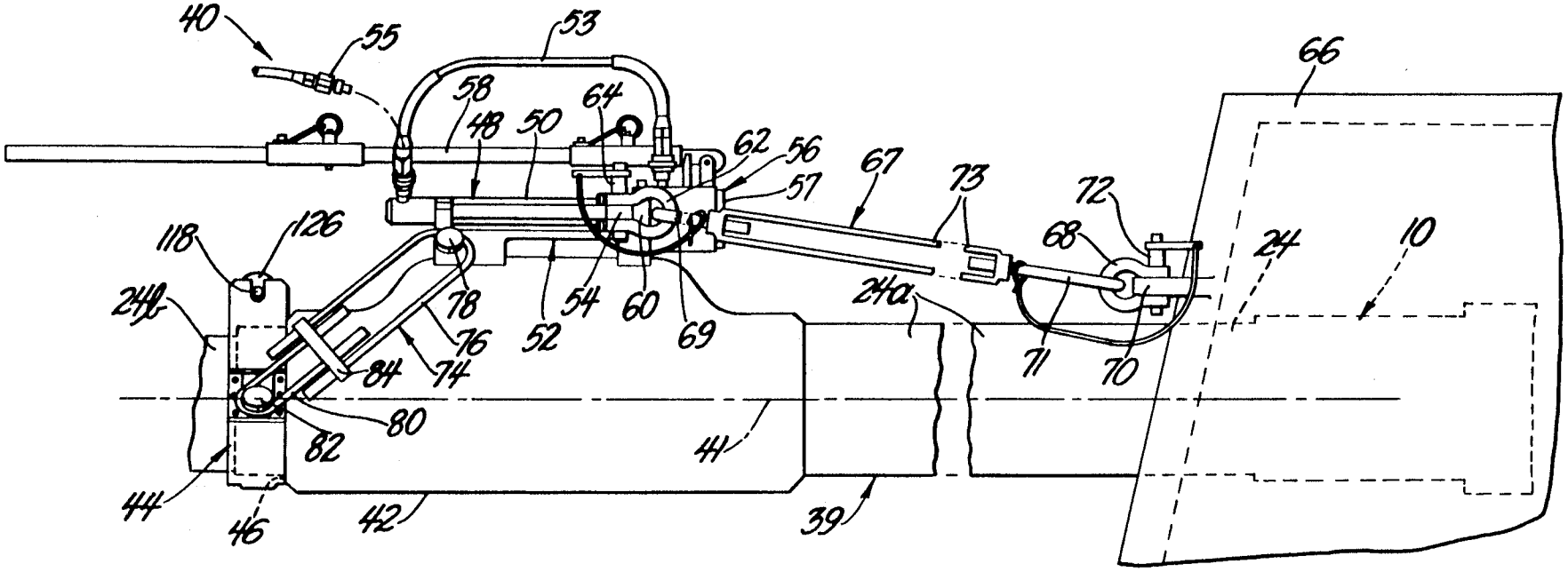
FIG. 2 is a side elevational view of our gun mount exerciser as installed on the gun assembly of a tank.

Shown in FIG. 2 is our gun mount exerciser 40 for translating inner cylinder 24 and thereby translating cannon 12 in mimicry of a recoil motion. Details of various parts of the exerciser are shown in subsequent Figures. Cannon 12 itself is not shown in FIG. 2, it being understood that the cannon extends through, and is fixed relative to, an outer barrel case comprised of inner cylinder 24, inner cylinder extension 24*a*, bore evacuator 42 and inner cylinder extension 24*b*. Cannon 12, inner cylinder 24, cylinder extensions 24*a* and 24*b*, bore evacuator 42 and gun mount assembly 10 are all part of the overall gun assembly 39. The group of elements and bore evacuator 42 may for convenience be referred to collectively as the outer barrel case. Bore evacuator 42 is a known device for eliminating gases produced when firing cannon 12 and will not be explained further here.

Exerciser 40 includes a clamp assembly 44 encircling cylinder extension 24*b* and bearing axially against a shoulder 46 formed between extension 24*b* and bore evacuator 42. The exerciser also includes a mounted cylinder assembly 48 having a hydraulic cylinder 50, a stationary member 54 to which the cylinder is fixed, and a frame 52 mounted atop evacuator 42. The frame is fastened to clamp assembly 44 by a cable connector 74 comprised of a larger cable segment 76 looped around knob 78 on frame 52, a smaller cable segment 80 looped around knob 82 on clamp assembly 44, and a cable retention plate 84 to which the ends of the cable segments are secured. The exerciser further includes a hydraulic hand pump 56 disposed immediately above bore evacuator 42 and fixed to frame 52 at a point between turnbuckles 67. The pump has a segmented handle 58 which is manually pushed and pulled to operate the pump. The handle lies in a vertical plane passing through axis 41 so that manipulation of the handle has minimal tendency to exert lateral force on assembly 48, so, for example, there is little or no force pulling knob 78 off cable 76. Frame 52 provides a convenient mounting platform for the pump so the main body 57 of pump 56 does not move when handle 58 is pushed or pulled. A hydraulic line 53 is connected between main body 57 of pump 56 and cylinder 50. Optionally, hydraulic line 55 from a motor-operated pump (not shown) can be attached to cylinder 50 instead.

Figure 4:
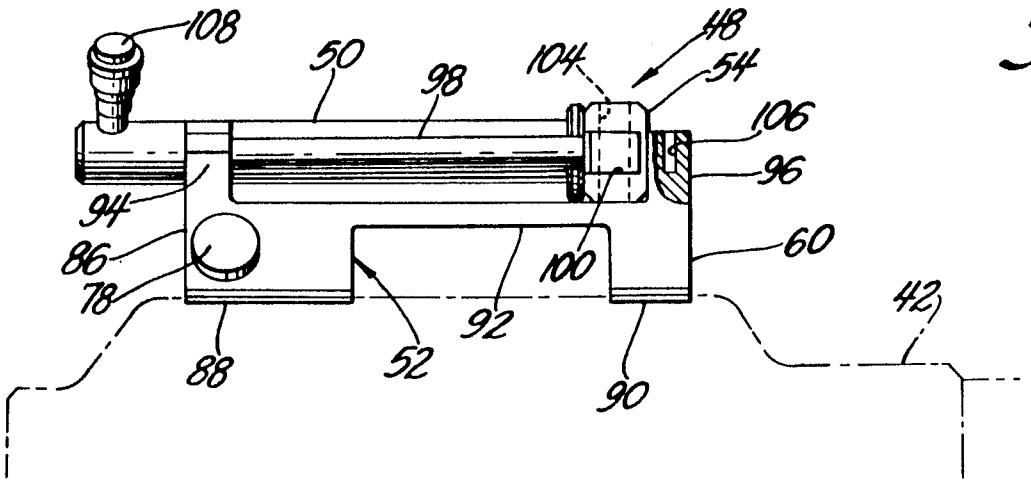
FIG. 4 is side elevational view of the mounted cylinder assembly of our gun mount exerciser.
Figure 6:
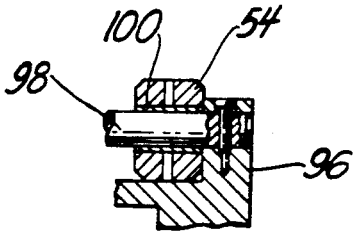
FIG. 6 is a view along line 6—6 in FIG. 3.

Actuation of cylinder 50 causes a ram inside cylinder 50 (not shown) to push rightward in FIG. 4 against stop 96 of frame 52, whereby block 60 and the rest of frame 52 move to the right relative to stationary member 54. Frame 52 slides on stationary member 54 and remains fixed relative to evacuator 42 as evacuator 42 translates with the cannon. The stationary member is kept from moving leftward away from turret member wall 66 (FIG. 2) by a series of connectors. The first connector is a shackle 62 held to stationary member 54 by means of quick release pin 64. Connected to shackle 62 is a turnbuckle 67 which is in turn connected to another shackle 68. Shackle 68 is connected to turret bracket 70 by means of quick release pin 72. Turnbuckle 67 is itself comprised of eyes 69 and 71 and body 73. Stationary member 54 is prevented from rightward movement by cylinder 50. Since cylinder 50 is attached to member 54 and exerts a rightward force on stop 96 of frame 52 during actuation, cylinder 50 exerts a leftward reactionary force on stationary member 54. This leftward reactionary force prevents rightward movement of stationary member 54.

Shown in FIGS. 3 through 6 are further details of mounted cylinder assembly 48. One-piece frame 52 has a rearward block 60 and a forward block 86 connected by a bridge 92, the blocks each having an curved bottom such as that shown for block 86 in FIG. 5. The curved bottoms each have a pad, as at 88 and 90, for engagement with bore evacuator 42. The upper part of block 60 defines a projection 96 against which a ram (not shown) from cylinder 50 pushes when the cylinder is actuated. The upper part of forward block 86 defines two projections 94 (FIGS. 3 and 4) which act as stops to limit rightward travel in FIG. 3 of frame 52 relative to stationary member 54. Extending from each projection 94 through projection 96 is a round rail 98 which slides through one of apertures 100 (FIG. 6) defined in stationary member 54. It will be understood that actuation of cylinder 50 pushes projection 96 away from stationary member 54, whereby the entire frame 52 slides to the right in FIGS. 3 and 4. Meanwhile member 54 remains stationary. Frame 52 continues to slide rightward until projections 94 bear against stationary member 54. When frame 52 slides to the right, clamp assembly 44 and the assembly of cylinder 24, cylinder extension 24*a*, cylinder extension 24*b* bore evacuator 42, and cannon 12 translates rightward as well.

Mounted cylinder assembly 48 has various features to facilitate connection to other components of gun mount exerciser 40. First, stationary block 54 has lateral extensions 102 to accommodate shackles 62 (FIG. 2) and has apertures 104 to accommodate quick release pins 64 by which shackles 62 are fastened to stationary member 54. Second, projection 96 of frame 52 defines threaded apertures 106 (FIG. 3) where pump 56 is bolted to frame 52. Finally, knobs 78 and 82 of clamp assembly 44 are circumferentially grooved to accommodate cables 76 and 80. Also, cylinder 50 has a hydraulic fitting 108 for fluid connection to hand pump 56 or any motor operated pump (not shown).

Figure 7:
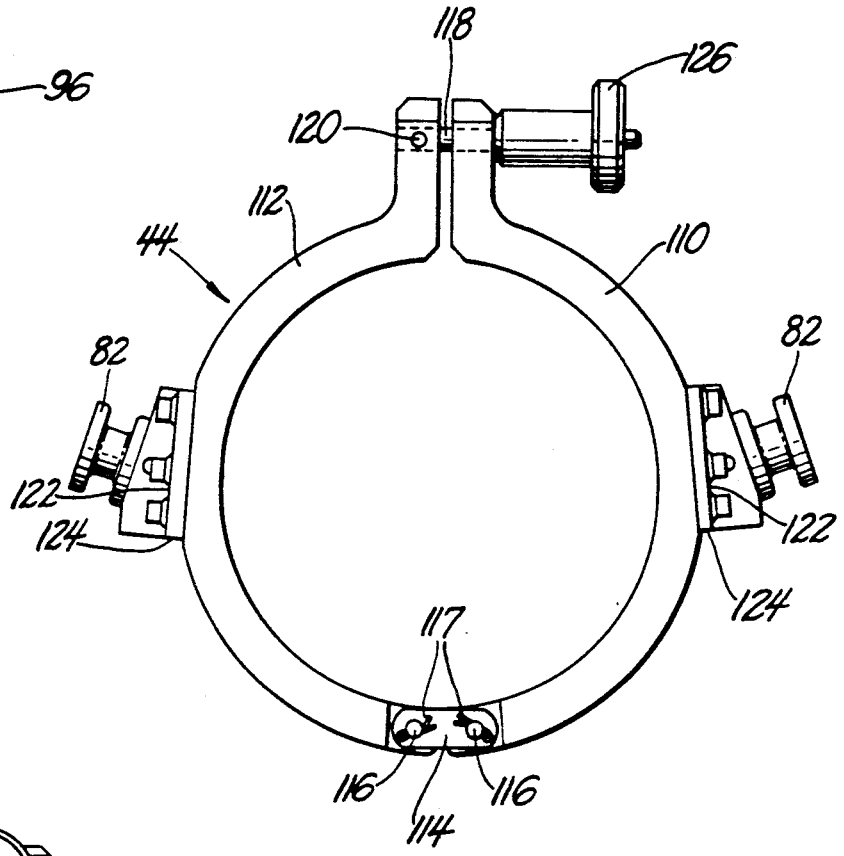
FIG. 7 is a front elevational view of the clamp of our gun mount exerciser.
Figure 8:
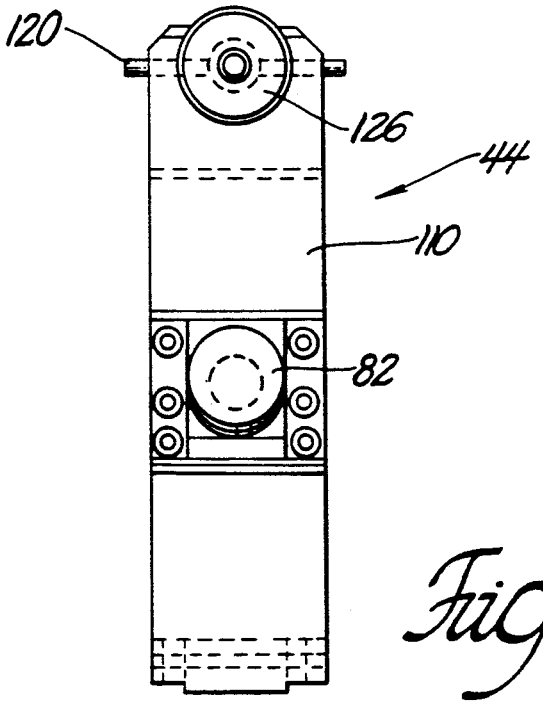
FIG. 8 is a side elevational view of the clamp of our gun mount exerciser.

FIGS. 7 and 8 show details of clamp assembly 44, which comprises ring halves 110 and 112 connected by a two-hole hinge link 114. Hinge pins 116 pass through link 114 and through respective ring halves 110 and 112 and are secured by cotter pins 117. The ring halves are releasably fastened by a shaft 118 having lock pin 120 extending therethrough and a knob 126 at one end for ease of manipulating shaft 118 through the ring halves. Bolted at flats 122 on the ring halves are mounts 124 to which are fixed cable engaging knobs 82. Knobs 82, as well as knobs 78 of assembly 48, are circumferentially grooved to accommodate cable segments 80 and 76, respectively.

It will be noted that the circumferential grooves on knobs 78, the circumferential grooves on knobs 82, cable segment 76, and cable segment 80 all lie in the same plane. This plane and the cable segments either do not touch any part of gun assembly 39 (including bore evacuator 42) or touch this assembly only tangentally. The purpose of keeping the aforementioned grooves and cables in such a plane is to prevent out-of-plane tension forces from pulling the cables off the knobs during gun exercising. One purpose of mounts 124 is to position the circumferential grooves of knobs 82 within the aforementioned plane.

After cannon 12 and inner cylinder 24 have been forced so far rightward that projections 94 of frame 52 abut stationary member 54, pressure to cylinder 50 is released. The release of pressure can be done by any suitable means, such as a valve (not shown) in pump 56. Spring 32 (FIG. 1) in toroidal space 30 will then translate cannon 12 leftward, to the FIG. 1 position. The process of repressurizing cylinder 50 to again translate to the right can then be repeated. After several sets of such back-and-forth translations of cannon 12, seals 34, 36 and 38 will be sufficiently wetted with hydraulic fluid, whereupon the process for exercising the gun assembly can be terminated.

We wish it to be understood that we do not desire to be limited to the exact details of construction shown and described herein since obvious modifications will occur to those skilled in the relevant arts without departing from the spirit and scope of the following claims.

We claim:

1. A gun mount exerciser for translating a cannon in a gun assembly, wherein the gun assembly has a gun mount subassembly in which the cannon is translatable and wherein the gun assembly has a barrel case extended from the gun mount subassembly and fixed around the cannon, the gun mount exerciser comprising:

a fluidically actuated cylinder;

accouplement means for connecting the cylinder to the barrel case;

means to limit a stroke of the cylinder to a controlled degree of translation;

a wall with respect to which the cannon translates;

attachment means to connect the fluidically actuated cylinder to the wall;

a stationary member fixed relative to the wall;

wherein the cylinder is mounted to the stationary member, the cylinder exerts a force against the stationary member and away from the wall when the cylinder is actuated, and the attachment means includes a tensionable means connected between the stationary member and the wall;

whereby the stationary member is held motionless relative to the wall by two opposing forces, the first opposing force being the reaction force of the cylinder against the stationary member when the cylinder is actuated and the second force being tension on the tensionable means.

2. The gun mount exerciser of claim 1 wherein the accouplement means includes:

a frame slidably translatably engaged with the stationary member, the frame translated with respect to the stationary member by the cylinder;

a clamp fixed to the outer barrel case;

coupling means for connecting the frame to the clamp, whereby the frame is fixed relative to the barrel case.

3. A gun mount exerciser for translating a cannon in a gun assembly, wherein the gun assembly has a gun mount subassembly in which the cannon is translatable and wherein the gun assembly has a barrel case extended from the gun mount subassembly and fixed around the cannon, the gun mount exerciser comprising:

a wall with respect to which the cannon translates;

a fluidically actuated cylinder;

a stationary member to which the fluidically actuated cylinder is mounted, the stationary member being fixed relative to the wall;

a frame fixed relative to the barrel case but slidably translatably engaged with the stationary member, the frame translated with respect to the stationary member by the fluidically actuated cylinder;

a stop on the frame, the stop preventing translation beyond a controlled degree of the frame with respect to the stationary member;

a clamp on the barrel case and fixed thereto.

4. The gun mount exerciser of claim 3 further including:

a first coupling means connecting the stationary member to the wall;

a second coupling means for connecting the frame to the clamp.

5. The gun mount exerciser of claim 4 wherein the first coupling means comprises:

a turnbuckle manually adjustable in length;

a shackle at each end of the turnbuckle;

a first quick-release pin connecting one shackle to the wall;

a second quick-release pin connecting another shackle to to the stationary member.

6. The gun mount exerciser of claim 4 wherein the stationary member is held motionless relative to the wall by two opposing forces, a first opposing force being the reaction force of the cylinder against the stationary member when the cylinder is actuated and a second force being tension on the first coupling means.

7. The gun mount exerciser of claim 4 wherein the frame defines a padded base surface faced conformingly against the outer barrel case.

8. The gun mount exerciser of claim 3 further comprising:

a rail mounted on the frame, the stop being at one end of the frame;

the stationary member defining an aperture through which the rail slides during translation of the frame.

9. The gun mount exerciser of claim 3 further comprising a manually operated pump fixed to the frame, the pump having an elongate handle pivotable in a plane passing through a longitudinal axis of the gun assembly.

10. A gun mount exerciser for effecting a controlled degree of translation of a cannon in a gun assembly, the gun assembly having a gun mount subassembly on the cannon allowing the controlled degree of translation of the cannon so as to absorb recoil force from the cannon when the cannon is fired, the gun assembly further having an outer barrel case extending from the gun mount subassembly and fixed around the cannon, the outer barrel case defining a shoulder between a larger diameter section thereof and a smaller diameter section thereof, the gun mount exerciser comprising:

a wall with respect to which the cannon translates;

a fluidically actuated cylinder;

a stationary member to which the fluidically actuated cylinder is mounted, the stationary member being fixed relative to the wall;

a first coupling means connecting the stationary member to the wall;

a frame fixed relative to the outer barrel casing, the frame slidably translatably engaged with the stationary member and translated by the fluidically actuated cylinder with respect to the stationary member;

a stop on the frame, the stop preventing translation beyond the controlled degree of the frame with respect to the stationary member;

a clamp encircling the outer barrel case and fixed thereto, the clamp abutting the shoulder of the outer barrel case;

second coupling means for connecting the frame to the clamp and holding the clamp against the shoulder, whereby the frame is fixed relative to the barrel case.

* * * * *